US011614309B2

(12) United States Patent
Zhao

(10) Patent No.: US 11,614,309 B2
(45) Date of Patent: Mar. 28, 2023

(54) TARGET DISC HOLDER

(71) Applicant: Qingdao Senwode Electrical and Mechanical Co., Ltd., Shandong (CN)

(72) Inventor: Yingchun Zhao, Shandong (CN)

(73) Assignee: Qingdao Senwode Electrical and Mechanical Co., Ltd, Qingdao (CN)

( * ) Notice: Subject to any disclaimer, the term of this patent is extended or adjusted under 35 U.S.C. 154(b) by 0 days.

(21) Appl. No.: 16/376,679

(22) Filed: Apr. 5, 2019

(65) Prior Publication Data

US 2022/0390212 A1 Dec. 8, 2022

(51) Int. Cl.
*F41J 1/10* (2006.01)

(52) U.S. Cl.
CPC ..... *F41J 1/10* (2013.01)

(58) Field of Classification Search
CPC ..... F41J 1/10; F41J 5/18; F41J 7/04
USPC ..... 273/390–392, 406–408; 182/183.1, 182/186.1–186.5
See application file for complete search history.

(56) References Cited

U.S. PATENT DOCUMENTS 1,580,935 A * 4/1926 Vidon ..... E04G 1/32 182/182.4
2,854,290 A * 9/1958 Steen ..... E04G 1/32 182/178.1
3,036,657 A * 5/1962 Ladue ..... B25H 1/06 182/224
3,175,642 A * 3/1965 Neeley ..... E04G 1/32 182/224
4,278,148 A * 7/1981 Daley ..... B25H 1/06 182/186.3
4,325,463 A * 4/1982 Taylor ..... B25H 1/06 182/155
4,461,370 A * 7/1984 Connell ..... B25H 1/06 182/186.3
4,884,658 A * 12/1989 Banfield ..... B25H 1/06 182/129
5,141,077 A * 8/1992 Zuercher ..... B25H 1/06 182/186.3
5,377,780 A * 1/1995 Dunaway ..... B25H 1/06 182/186.3
5,484,037 A * 1/1996 Neumarkel ..... B25H 1/06 182/185.1
5,913,381 A * 6/1999 D'Armond, Jr. ..... E04G 1/32 182/186.3
6,758,307 B1 * 7/2004 Ols ..... B25H 1/06 182/186.3

(Continued)

*Primary Examiner* — Eugene L Kim
*Assistant Examiner* — Christopher Glenn
(74) *Attorney, Agent, or Firm* — Yong Chen

(57) ABSTRACT

The invention discloses a target disc holder which comprises a cross beam, several connecting tubes, several clamping plates and several supporting members; wherein the clamping plates are detachably fixed at both ends of the cross beam; the supporting members are detachably fixed on the clamping plates; the supporting members comprise several supporting tubes; and the connecting tube is fixedly inserted into each of the supporting tubes. The target disc holder is convenient to disassemble and assemble, is easy to repair and replace, and has low cost. With a unique structural design and reasonable use of materials, the target disc holder has stronger stability and does not collapse after being shot.

8 Claims, 11 Drawing Sheets

(56) References Cited

U.S. PATENT DOCUMENTS

| | | | | |
|---|---|---|---|---|
| 6,810,996 | B2 * | 11/2004 | Rump | B25H 1/06 182/153 |
| 8,608,170 | B2 * | 12/2013 | Ball | F41J 1/10 273/407 |
| 8,910,943 | B2 * | 12/2014 | Lee | F41J 1/01 273/392 |
| 9,267,769 | B1 * | 2/2016 | Gempler | B25H 1/06 |
| 10,088,279 | B2 * | 10/2018 | Hoy, Jr. | F41J 1/10 |
| 2002/0038741 | A1 * | 4/2002 | Krajec | B25H 1/06 182/186.3 |
| 2009/0272861 | A1 * | 11/2009 | Bevelacqua | B25H 1/02 248/188 |
| 2010/0294595 | A1 * | 11/2010 | Osburn | E04G 1/36 182/186.3 |
| 2013/0306806 | A1 * | 11/2013 | Hoyle | A47B 13/02 248/121 |
| 2018/0045495 | A1 * | 2/2018 | Harris | F41J 7/06 |
| 2018/0087880 | A1 * | 3/2018 | Fernandez | F41J 7/04 |
| 2018/0195840 | A1 * | 7/2018 | Hoy, Jr. | F41J 7/04 |
| 2018/0299232 | A1 * | 10/2018 | Thompson | F41J 1/10 |
| 2019/0025016 | A1 * | 1/2019 | Schroedel | F41J 1/10 |

* cited by examiner

TARGET DISC HOLDER

FIELD OF THE INVENTION

The invention relates to the technical field of shooting, and particularly to a target disc holder.

BACKGROUND OF THE INVENTION

Nowadays, as more and more people like shooting, various kinds of target disc holders with different functions are available on the market, but most of the target disc holders have a relatively single function, and are also more or less problematic when in use, which cannot provide a better experience to consumers. Here are a few problems with the target disc holders currently on the market:

1. most of the target disc holders have a single structure which is sometimes formed by afoot and a vertical rod, and such target disc holders easily collapse after being shot, which brings great inconvenience to users;
2. some of the target disc holders are complicated in mounting and difficult to disassemble, occupy more space, and are inconvenient to carry;
3. some of the target disc holders are integral such that the entire product has to be purposed after damage, which increases the cost of use by consumers; and
4. most of the target disc holders do not have an extended function, for example, only one target disc can be hung on some of the target disc holders, or the height and length cannot be changed, which cannot meet most of the requirements in use.

SUMMARY OF THE INVENTION

An object of the invention is to provide a target disc holder.

To achieve the above object, the invention provides the following technical solution: a target disc holder comprises a cross beam, several connecting tubes, several clamping plates and several supporting members; wherein the clamping plates are detachably fixed at both ends of the cross beam; the supporting members are detachably fixed onthe clamping plates; the supporting members comprise several supporting tubes; and the connecting tube is fixedly inserted into each of the supporting tubes. The target disc holder is convenient to disassemble and assemble, is easy to repair and replace, and has low cost.

Further, the cross beam is a squared timber.

Further, the length of the cross beam is adjustable.

Further, the cross beam comprises several extension rods, and ends of adjacent extension rods are detachably and fixedly connected. It is convenient to adjust the length of the target disc holder by increasing or reducing the number of the extension rods, thereby meeting the needs of different consumers.

Further, the adjacent extension rods are fixed by bolts and nuts after being inserted. The extension rods are convenient to disassemble and assemble, has low maintenance cost and can be more stably mounted.

Further, the bottom of the connecting tubes is detachably and fixedly connected to extension tubes. The arrangement of the extension tubes facilitates adjusting the height of the target disc holder.

Further, the clamping plates are integrally provided with curved connecting plates at lower ends thereof; the supporting members comprise supporting plates and the supporting tubes are fixedly connected at lower parts of the supporting plates; and the supporting plates are fixedly connected with the connecting plates. The target disc holder is convenient to disassemble and assemble, and has low maintenance and replacement cost.

Further, the clamping plates are arranged at opposite sides of one end of the cross beam; and the connecting plates of the two clamping plates are fixed on the corresponding supporting plates. This simple structure can improve the mounting stability of the clamping plates on the supporting members.

Further, the supporting plate is provided with multiple rows of adjustment holes for mounting the connecting plates. It is convenient to adjust the position of the clamping plate on the supporting plate so that cross beams or squared timbers of different widths can be mounted.

Further, the extension tubes and the connecting tubes have the same specification, and therefore are convenient to disassemble and replace.

The invention has the following technical effects: with a unique structural design and reasonable use of materials, the target disc holder of the invention has stronger stability and does not collapse after being shot;

the components of each part of the target disc holder are easily disassembled and occupy less space to facilitate storage;

each component of the product is a separate unit, and only the damaged components need to be replaced after damage, without the need to purchase the entire product again, thus greatly reducing the cost; and this product also has an extended function, and therefore can be assembled into a variety of product variants to meet the needs of more people.

Figure 1:
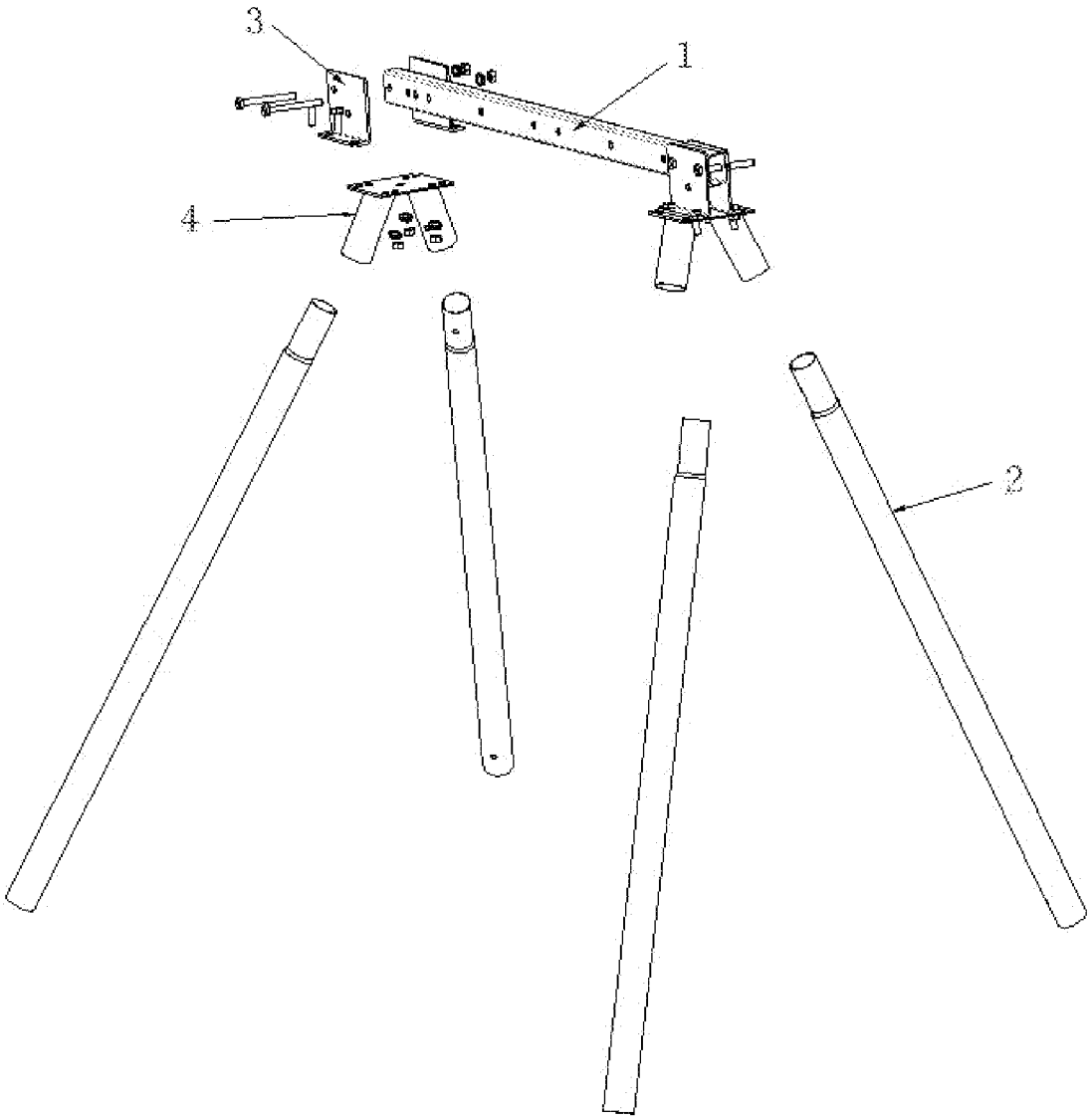
FIG. 1 is an exploded view of a target disc holder in Embodiment 1.

Reference numerals: 1. cross beam; 11. squared timber; 2. connecting tube; 21. extension tube; 3. clamping plate; 31. connecting plate; 4. supporting member; 41. supporting plate; 411. adjustment hole; 42. supporting tube; 5. extension rod; 6. target disc.

DETAILED DESCRIPTION OF THE INVENTION

The technical solutions in the embodiments of the invention will be clearly and completely described below in conjunction with the drawings in the embodiments of the invention. It is apparent that the described embodiments are only part of rather than all of the embodiments in the invention. Based on the embodiments of the invention, all other embodiments obtained by the ordinary persons skilled in the art without inventive work belong to the protection scope of the invention.

Embodiment 1

Figure 2:
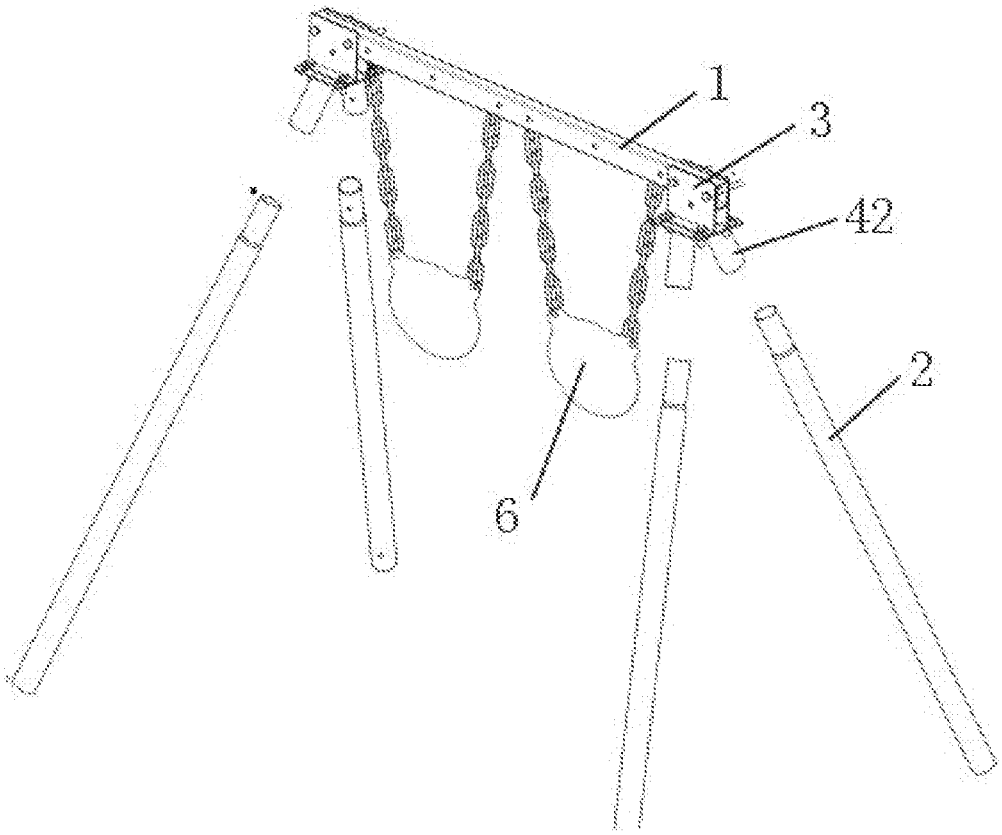
FIG. 2 is an exploded view of a target disc holder (with target discs) in Embodiment 1.

Referring to FIGS. 1 to 2, a target disc holder comprises a cross beam 1, connecting tubes 2, clamping plates 3 and supporting members 4; wherein four clamping plates 3 are disposed, two of which are clamped at two horizontal sides of one end of the cross beam 1 and the other two of which are clamped at two horizontal sides of the other end of the cross beam 1; the clamping plates 3 and the cross beam 1 are fastened by bolts and nuts; and the clamping plates 3 are integrally provided with curved connecting plates 31 at lower ends thereof.

Two supporting members 4 are disposed, which are respectively arranged at lower parts of the clamping plates 3; specifically, the supporting members 4 comprise supporting plates 41 and supporting tubes 42 which are fixedly connected; the supporting plates 41 are arranged at lower parts of the connecting plates 31, and the supporting plates 41 and the connecting plates 31 are fastened by bolts and nuts; and preferably, the connecting plates 31 on the two clamping plates 3 at one end of the cross beam 1 are fixed on the supporting plate 41, thereby improving the connection stability of the clamping plates 3.

Two supporting tubes 42 are arranged on each supporting member 4. The two supporting tubes 42 are distributed on lower surfaces of the supporting plate 41 and are symmetrical relative to the cross beam 1. One connecting tube 2 is fixedly inserted into each of the supporting tubes 42 and the connecting tubes 2 are supported on the ground. Preferably, the connecting tubes 2 are φ38 necked galvanized cylindrical tubes; and the connecting tubes 2 are inserted into the supporting tubes 42 and fixed by single-head elastic sheets. The target disc holder has a height of 35 inches and a length of 33 inches, and one or two target discs 6 can be suspended.

Embodiment 2

Figure 3:
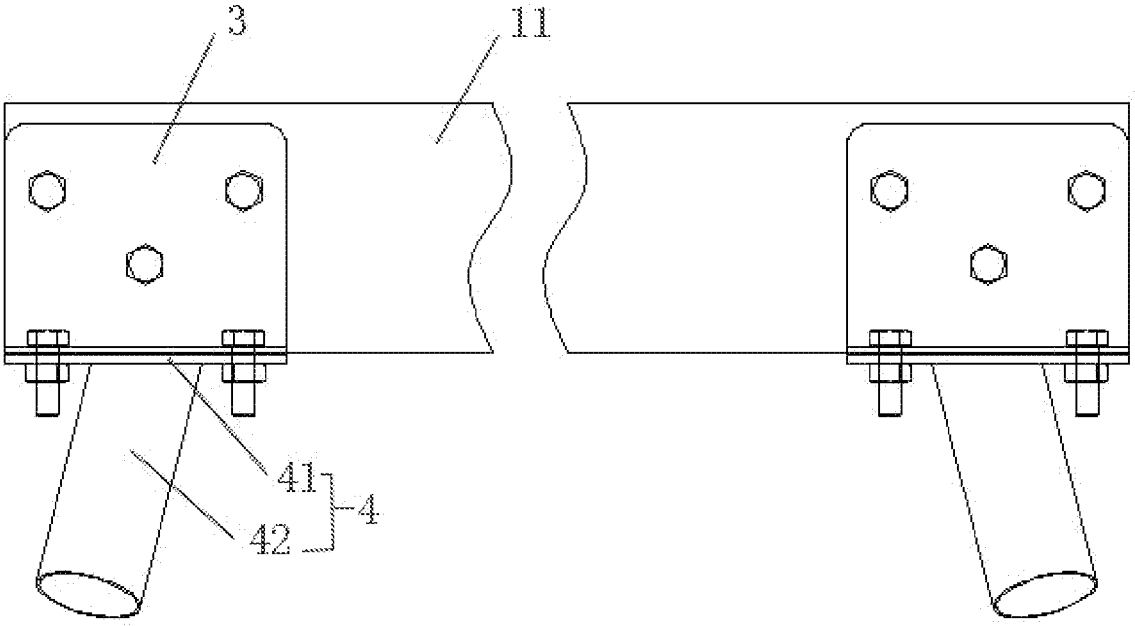
FIG. 3 is an assembly view of a 1.5-inch squared timber used instead in Embodiment 2.
Figure 4:
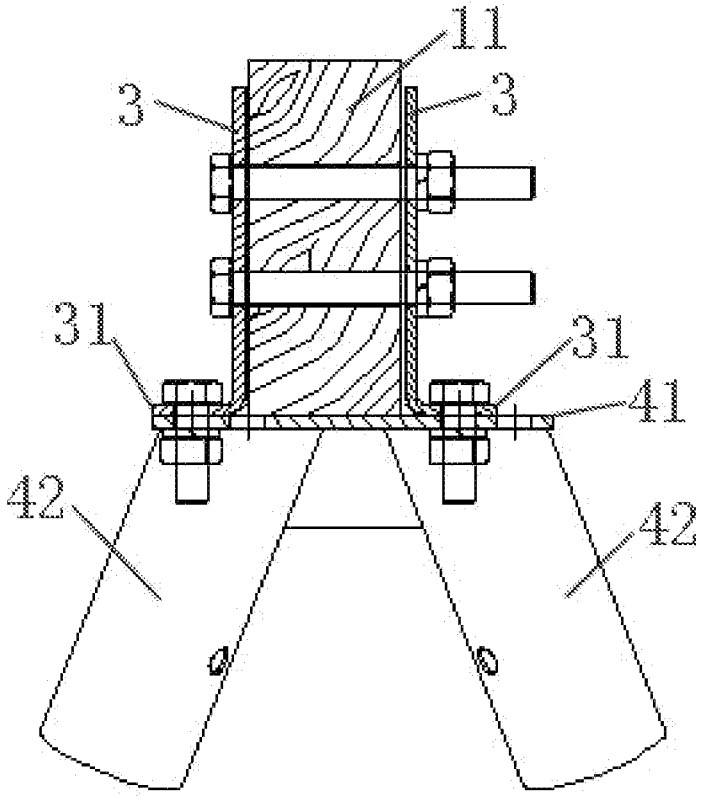
FIG. 4 is a sectional view of the 1.5-inch squared timber used instead in Embodiment 2.
Figure 5:
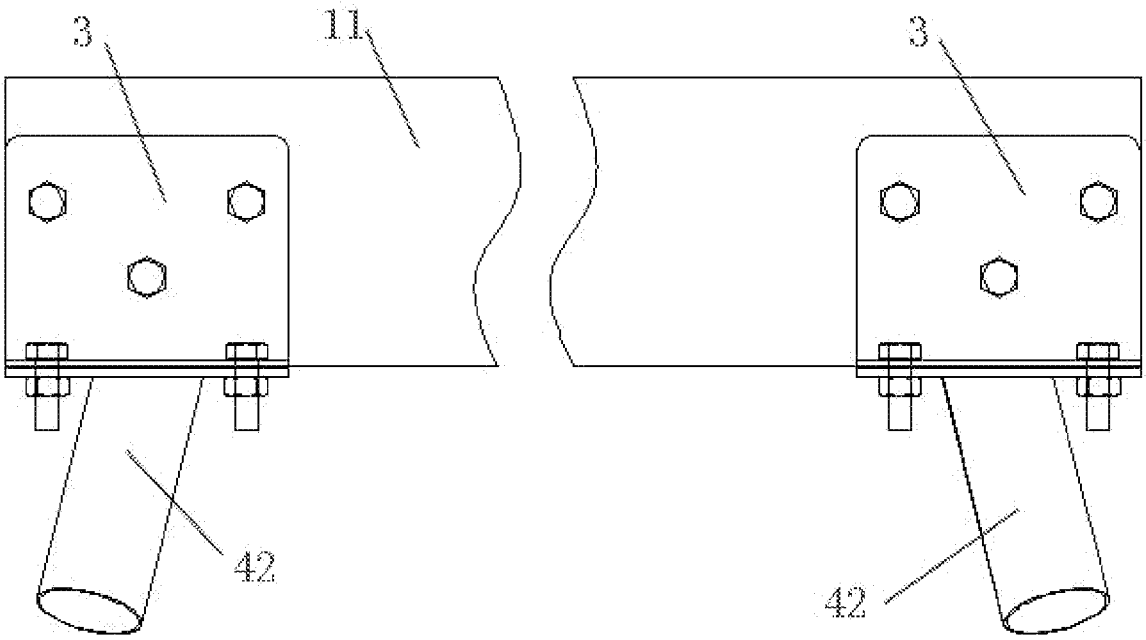
FIG. 5 is an assembly view of a 2-inch squared timber used instead in Embodiment 2.
Figure 6:
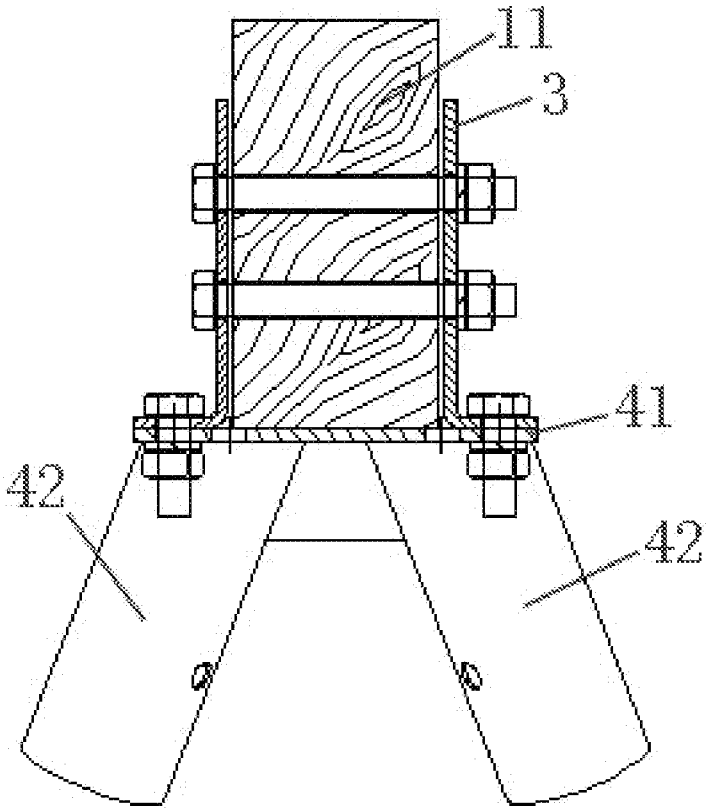
FIG. 6 is a sectional view of the 2-inch squared timber used instead in Embodiment 2.
Figure 7:
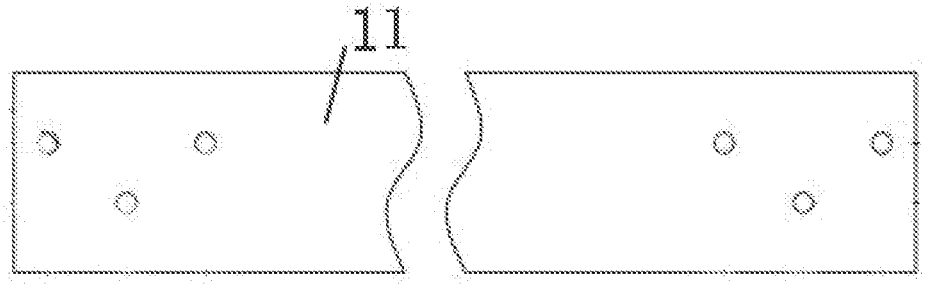
FIG. 7 is a schematic view of mating hole sites between the squared timber used instead and clamping plates in Embodiment 2.

Referring to FIGS. 3-7, based on Embodiment 1, the cross beam 1 can be replaced with a squared timber 11 of the same size, wherein the squared timber 11 may have a width of 1 inch, 1.5 inches or 2 inches, which is commercially available. The supporting plate 41 of the supporting member 4 is provided with multiple rows, preferably two rows of adjustment holes 411 at both sides thereof, and the above squared timbers 11 of various sizes are placed by adjusting the relative positions between the supporting plates 41 and the clamping plates 3. FIG. 3 is an assembly view of a 1.5-inch squared timber 11 used instead. FIG. 4 is an assembly view of a 2-inch squared timber 11 used instead. Mating hole sites between the squared timber 11 used instead and the clamping plates 33 are as shown in FIG. 5.

Embodiment 3

Figure 8:
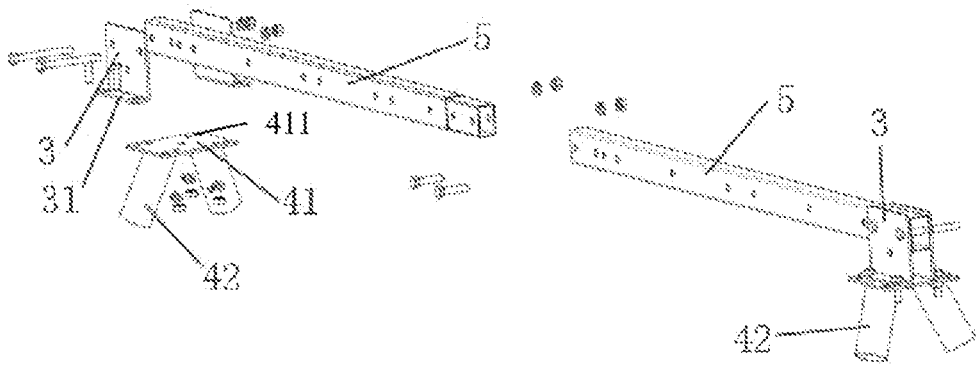
FIG. 8 is a partially exploded view of a target disc holder (with two extension rods) in Embodiment 3.
Figure 9:
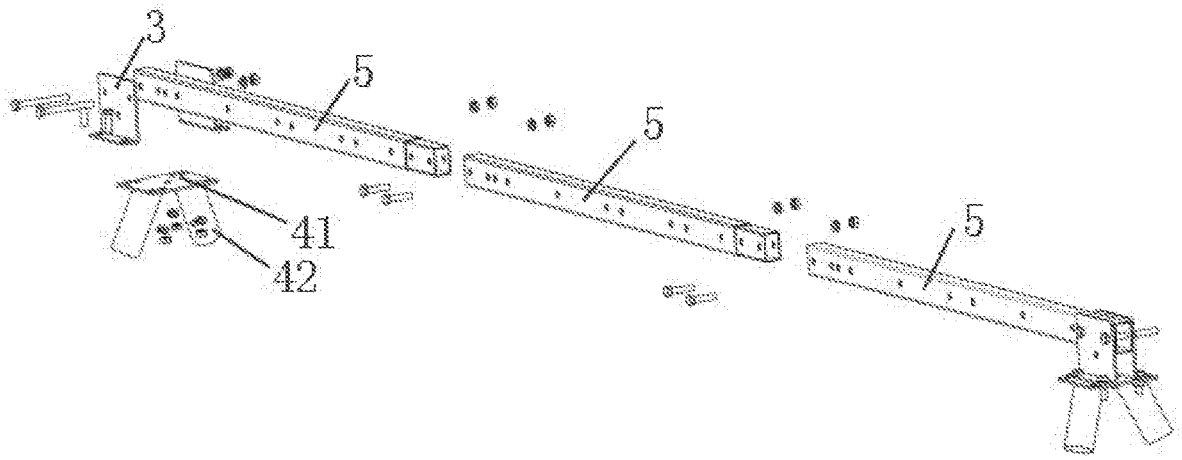
FIG. 9 is a partially exploded view of a target disc holder (with three extension rods) in Embodiment 3.

Referring to FIGS. 8-9, based on Embodiment 1, the length of the cross beam 1 is adjustable so that the length of the target disc holder is increased and more target discs 6 can be suspended.

Preferably, the cross beam 1 comprises several extension rods 5, and ends of adjacent extension rods 5 are detachably and fixedly connected. Preferably, the adjacent extension rods 5 are fixed by bolts and nuts after being inserted, so that the number of the extension rods 5 can be increased or reduced depending on the circumstance to achieve the purpose of adjusting the length of the cross beam 1, thus providing more convenience in use. The specification and length of the extension rods 5 may be the same or different.

Embodiment 4

Figure 10:
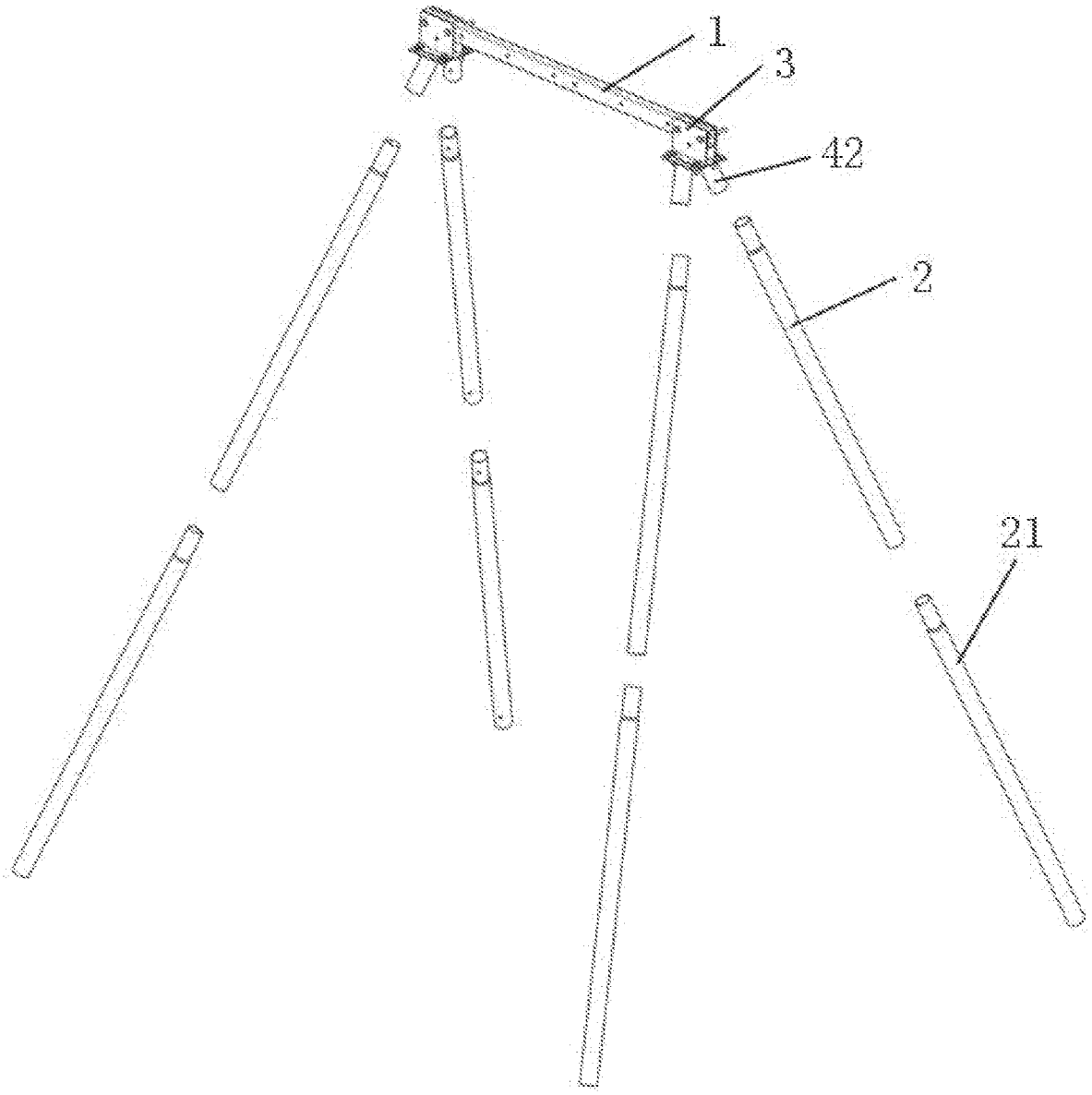
FIG. 10 is an exploded view of a target disc holder (with extension tubes) in Embodiment 4.

Referring to FIG. 10, based on Embodiment 1, extension tubes 21 are fixedly inserted at the bottom of the connecting tubes 2, so that the height of the target disc holder is increased. Preferably, the extension tubes 21 and the connecting tubes 2 have the same specification and may be φ38 necked galvanized cylindrical tubes, and therefore are more convenient to disassemble and replace.

Figure 11:
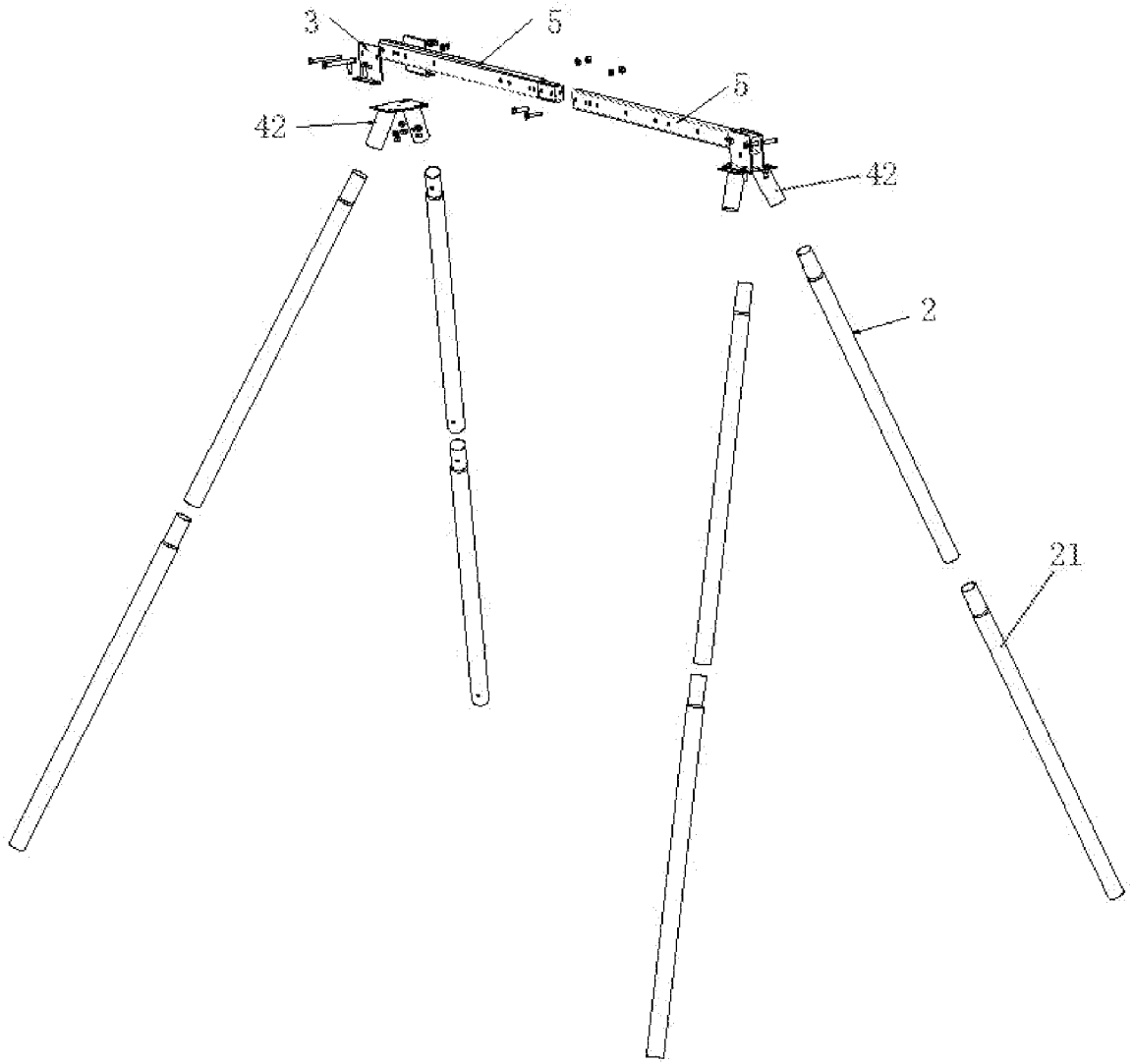
FIG. 11 is an exploded view of a target disc holder (with extension rods and extension tubes) in Embodiment 4.

Referring to FIG. 11, this embodiment can also be combined with the technical solution of Embodiment 3, so that the height and length of the target disc holder are increased or reduced, thereby meeting the needs of more consumers.

In summary, the invention can be better implemented.

The invention claimed is:

1. A target disc holder, comprising:

a cross beam, a plurality of connecting tubes, a plurality of clamping plates, and a plurality of supporting members;

wherein the plurality of clamping plates are detachably fixed at two ends of the cross beam, two of the plurality of clamping plates are arranged at opposite sides of each of the two ends of the cross beam, each clamping plate of the plurality of clamping plates is integrally provided at a lower end thereof with a connecting plate and the said connecting plate is perpendicular to the said clamping plate;

each of the plurality of supporting members comprises a supporting plate and a plurality of supporting tubes, the supporting plate is provided with a plurality of rows of adjustment holes for being connected with the connecting plate, and the plurality of connecting tubes are fixedly inserted into the plurality of supporting tubes.

2. The target disc holder according to claim 1, wherein the cross beam is a squared timber.

3. The target disc holder according to claim 1, wherein a length of the cross beam is adjustable.

4. The target disc holder according to claim 3, wherein the cross beam comprises a plurality of extension rods, and ends of adjacent extension rods are detachably and fixedly connected.

5. The target disc holder according to claim 4, wherein the adjacent extension rods are fixed by bolts and nuts after being inserted.

6. The target disc holder according to claim 1, wherein a bottom of each of the plurality of connecting tubes is detachably and fixedly connected to an extension tubes.

7. The target disc holder according to claim 1, wherein the plurality of supporting tubes are fixedly connected at a lower part of the supporting plate.

8. The target disc holder according to claim 6, wherein the extension tubes and each of the plurality of connecting tubes have a same specification.

* * * * *